US005651231A

United States Patent [19]

Garland

[11] Patent Number: 5,651,231

[45] Date of Patent: Jul. 29, 1997

[54] VALVING

[76] Inventor: Thomas A. Garland, 76 Reservoir Cir., Jamestown, R.I. 02835

[21] Appl. No.: 297,250

[22] Filed: Aug. 26, 1994

[51] Int. Cl.[6] ..... B65B 67/04

[52] U.S. Cl. ..... 53/258; 53/260; 53/284.7; 53/390; 53/570; 228/253; 228/254; 228/908

[58] Field of Search ..... 53/243, 244, 255, 53/258, 259, 260, 284.7, 390, 392, 459, 469, 475, 567, 570, 576, 575, 577; 206/366, 370; 215/311, 312, 313; 220/908, 203.05, 203.06, 252, 253, 254, 263; 4/484

[56] References Cited

U.S. PATENT DOCUMENTS

| | | | |
|---|---|---|---|
| 1,238,010 | 8/1917 | Fisher . | |
| 1,333,051 | 3/1920 | Young . | |
| 1,638,360 | 8/1927 | Olson . | |
| 1,788,958 | 1/1931 | Polk | 53/258 |
| 1,982,917 | 12/1934 | Lothrop et al. | 215/313 X |
| 2,713,959 | 7/1955 | Gilbert et al. | 53/243 X |
| 3,321,103 | 5/1967 | Phillips | 53/469 X |
| 3,322,477 | 5/1967 | Armijo | 53/570 X |
| 3,452,368 | 7/1969 | Couper | 53/567 X |
| 3,854,270 | 12/1974 | Cloud et al. | 53/243 X |
| 3,935,692 | 2/1976 | Miller | 53/390 X |
| 4,736,860 | 4/1988 | Bemis . | |
| 4,779,728 | 10/1988 | Hanifl et al. . | |
| 4,828,107 | 5/1989 | Spencer | 220/908 X |
| 4,869,049 | 9/1989 | Richards et al. . | |
| 4,890,733 | 1/1990 | Anderson . | |
| 4,924,919 | 5/1990 | Oyler | 53/469 X |
| 5,001,885 | 3/1991 | Bovella | 53/575 X |
| 5,046,614 | 9/1991 | Torres et al. . | |
| 5,076,429 | 12/1991 | Patrick et al. | 220/908 X |
| 5,147,055 | 9/1992 | Samson et al. . | |
| 5,337,540 | 8/1994 | Carroll | 53/570 X |
| 5,385,259 | 1/1995 | Bernstein et al. | 220/908 X |
| 5,473,858 | 12/1995 | Hayes | 53/575 X |

*Primary Examiner*—Daniel Moon
*Attorney, Agent, or Firm*—Perman & Green, LLP

[57] ABSTRACT

In one aspect of the invention, a piston is sized to slide along a first axis within a hollow cylinder, and the piston and cylinder assembly is rotatable about a second axis with respect to a support structure. In another aspect of the invention, a container is sized to receive a bag having a mouth larger than a characteristic cross-section of an article to be deposited therein. A member supported by the container has a hole sized in accordance with the characteristic cross-section of the article, and the mouth of the bag is releasably secured to the hole so that the bag is gathered to provide an opening into the bag sized in accordance with the characteristic cross-section of the article.

20 Claims, 6 Drawing Sheets

VALVING

BACKGROUND OF THE INVENTION

The present invention relates in general to pumping, valving, and storaging, and more particularly concerns apparatus for moving material from one location to another.

A search of subclasses 252, 254, 262, 263, 331, 334, 343, 904 and 908 of class 220 and subclass 37 of class D32 identified U.S. Pat. Nos. 5,147,055; 5,046,614; 4,890,733; 4,779,728; 4,736,860; 1,638,360; 1,333,051; and 1,238,010, which furnish background for the invention.

SUMMARY OF THE INVENTION

According to one aspect of the invention, a piston is sized to slide along a first axis within a hollow cylinder, and the piston and cylinder assembly is rotatable about a second axis with respect to a support structure.

Among other advantages of this aspect of the invention, an article or volume of material may be placed into the cylinder, the cylinder rotated about the second axis to a different orientation, and the piston slid along the first axis to eject the article or material from the cylinder. In this manner, the invention allows material to be moved or pumped from one region to another.

In one embodiment of this aspect of the invention, the cylinder, which has two open ends, is housed in a drum having a partially circular cross section along the second axis (which axis lies substantially perpendicular to the first axis). The piston is retained in the cylinder by rings disposed in the open cylinder ends, and a seal disposed between the piston and the cylinder reduces leakage therebetween. Typically, a portion of the drum surface is spherical.

A shroud supported by the support structure is disposed adjacent the drum, and a seal (e.g., a foam sheet and/or an o-ring) lies in the gap between the two. A hole in the shroud of substantially the same diameter as the cylinder is located such that the cylinder aligns with the hole when the drum is rotated about the second axis. A snout surrounding the shroud hole is sized to wedge into another hole in a bag retaining member, thereby trapping the mouth region of a bag between the hole and the snout. Together, the drum and shroud comprise a cover assembly that rotatably mounts to the container.

According to another aspect of the invention, a container is sized to receive a bag having a mouth larger than a characteristic cross section of an article to be deposited therein. A member supported by the container has a hole sized in accordance with the characteristic cross-section of the article, and the mouth of the bag is releasably secured to the hole so that the bag is gathered to provide an opening into the bag sized in accordance with the characteristic cross section of the article.

Among other advantages of this aspect of the invention, reducing the opening of the bag to reflect the characteristic cross-section of the article to be deposited therein makes the bag easier to seal. Moreover, if the gathered opening of the bag is sufficiently small, the bag may be grasped, sealed, and removed with a single hand, facilitating bag removal and replacement.

BRIEF DESCRIPTION OF THE DRAWINGS

Numerous other features, objects, and advantages of the invention will become apparent from the following detailed description when read in connection with the accompanying drawings, in which.

DESCRIPTION OF THE PREFERRED EMBODIMENTS

Figure 1:
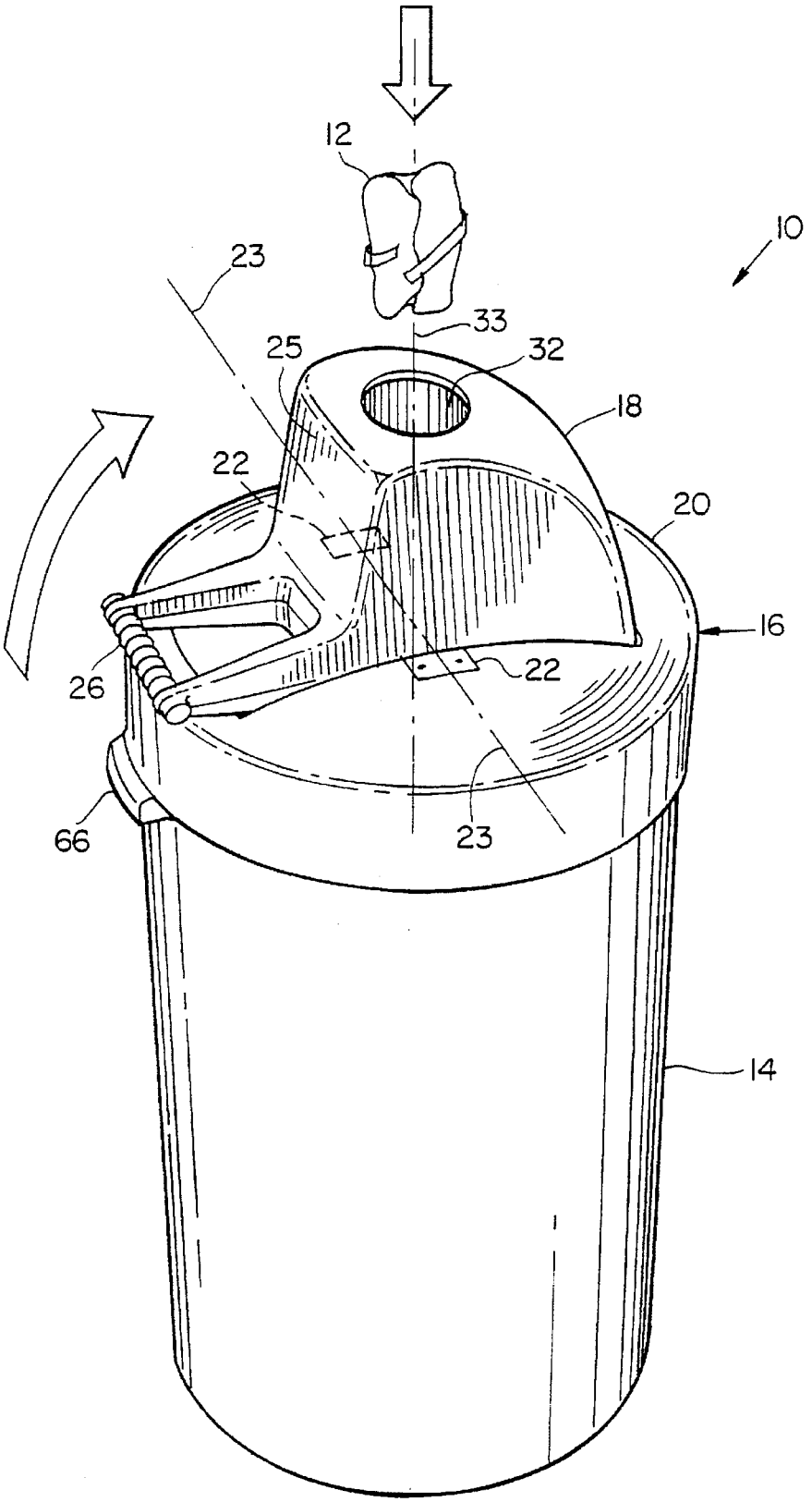
FIG. 1 is a perspective view of a diaper pail.
Figure 2:
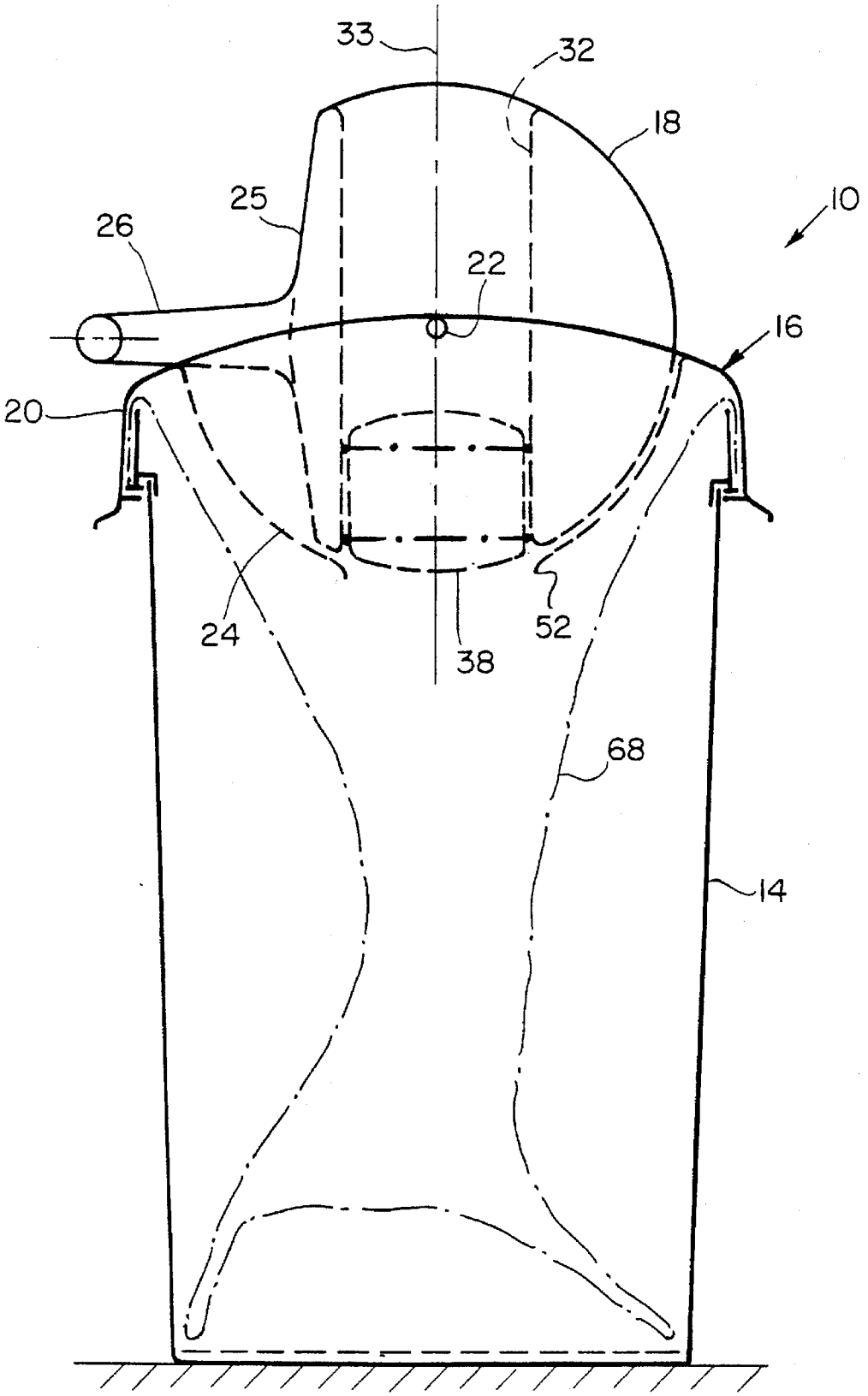
FIG. 2 is a cutaway side view of the diaper pail shown in FIG. 1.

With reference now to the drawings and more particularly to FIGS. 1 and 2, there are shown perspective and cutaway views, respectively, of an exemplary embodiment of the invention, a pail 10 for disposing of and storing, e.g., soiled diapers 12. Pail 10 includes a container 14 and a cover assembly 16 that releasably attaches to container 14. The fit between container 14 and cover assembly 16 is sufficiently close that, with cover assembly 16 in place, container 14 is essentially airtight.

Cover assembly 16 includes a drum 18 and a lid 20. A pair of hinge joints 22 having coaxial axes of rotation 23 attach drum 18 to lid 20, allowing drum 18 to be rotated about axis 23 with respect to lid 20, in the manner indicated in FIG. 1. Drum 18 has a generally uniform, partially circular cross-section along axis 23. Thus, drum 18, an otherwise generally cylindrical member, has a flat spot 25 oriented parallel to axis 23. A handle 26 projecting from flat spot 25 facilitates the rotation of drum 18 about axis 23. The flat spot 25 is aesthetic and is not necessary.

Figure 3A:
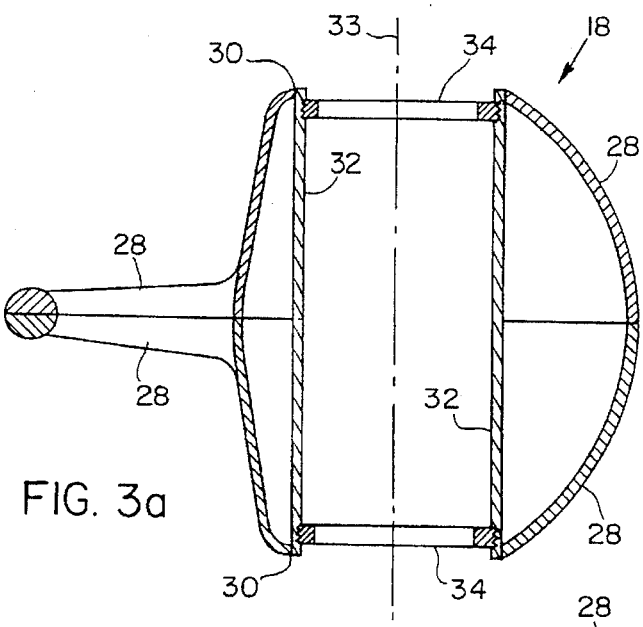
FIGS. 3*a* and 3*b* are cutaway side views of drums for use with the diaper pail shown in FIG. 1.
Figure 3B:
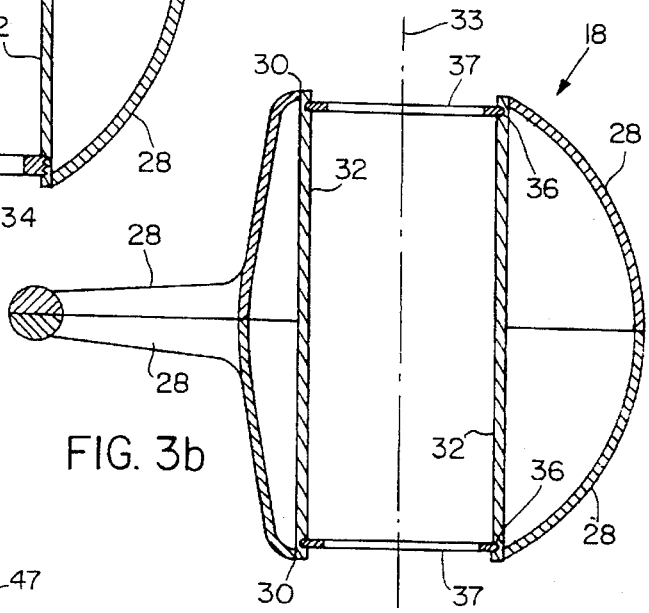

As shown in FIG. 3*a*, drum 18 comprises two substantially identical half-drum sections 28 molded from, e.g., plastic, and bonded or otherwise fastened together. Each of sections 28 has a hole 30 positioned to receive a cylinder 32. Cylinder 32, which is bonded to half-drum sections 28, has a longitudinal axis 33 perpendicular to axis 23. Cylinder 32, a continuous section of, e.g., polyvinyl chloride or other plastic pipe, is threaded at both ends to receive threaded insert rings 34. The inner diameters of both cylinder 32 and insert rings 34 are large enough to accommodate diaper 12. Alternatively, as shown in FIG. 3*b*, a snap-ring gland 36 may be provided at each end of cylinder 32 to receive a snap ring 37.

The outer diameter of a piston 38 disposed in cylinder 32 is slightly smaller than the inner diameter of cylinder 32, and slightly larger than the inner diameter of insert rings 34. Piston 38 is thus free to slide within cylinder 32 along axis 33, but is prevented from escaping by insert rings 34. As shown in FIG. 4*a*, a pair of o-rings 40 or other type of ring seal seated in o-ring glands 41 around the circumference of piston 38 seal piston 38 with respect to cylinder 32. Piston 38 further includes a weight 42, which is selected such that the combined weight of piston 38 and weight 42 is sufficient to cause piston 38 to travel to the point of lowest gravitational potential energy in cylinder 32.

Figure 4B:
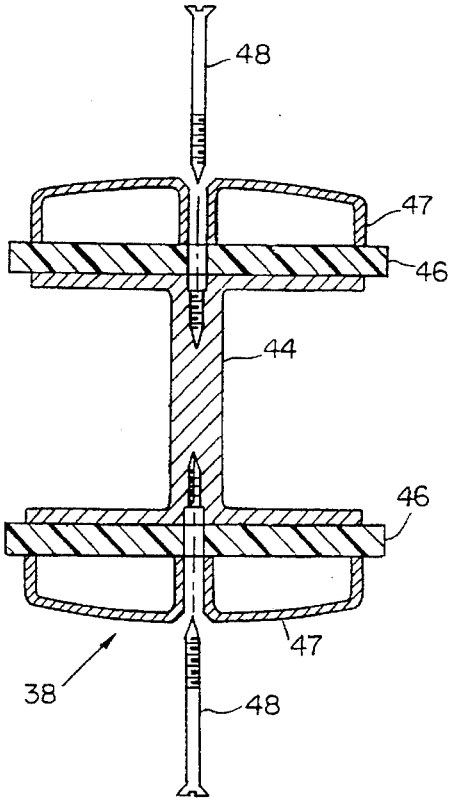
FIGS. 4*a* and 4*b* are cutaway side views of pistons for use with the diaper pail shown in FIG. 1.
Figure 4A:
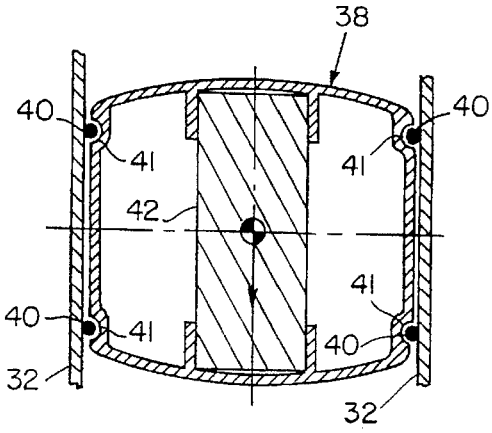

Alternatively, as shown in FIG. 4*b*, piston 38 may include a spool-shaped core 44. Circular wiper seals 46 disposed at opposite ends of core 44 are held in place by end caps 47, which attach to core 44 by screws 48. The outer diameters of core 44 and end caps 47 are slightly smaller than the inner diameter of cylinder 32, and the outer diameters of seals 46 are slightly larger than the inner diameter of cylinder 32. Because seals 46 are disposed between core 44 and end caps 47, tightening screws 48 axially compresses seals 46, increasing their outer diameter. Thus, the contact force between piston 38 and cylinder 12 (and therefore also the ease with which piston 38 slides within cylinder 32 and the degree of sealing at the piston-cylinder interface) may be adjusted by tightening and loosening screws 48. Any other suitable seal may be used, such as knife-edged wiper seals or piston rings seated in an annular recess of the piston.

Piston 38 is installed into drum 18 by removing one of insert rings 34, inserting piston 38 into cylinder 32, and reinstalling the insert ring 34. Piston 38 may be removed, e.g., for cleaning or replacing seals, by reversing this process.

The drum and piston shape shown in FIG. 2 is advantageous from the standpoint of providing a good seal because there is a continuous curved surface geometry and no flat at the top of the piston.

Figure 5:
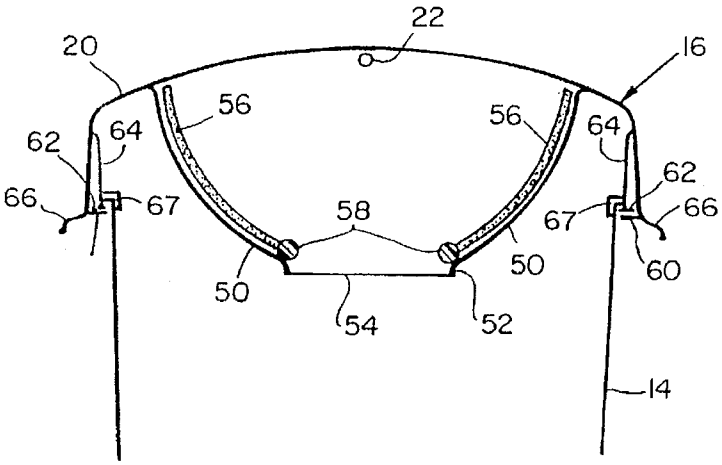
FIG. 5 is a cutaway side view of a lid for use with the diaper pail shown in FIG. 1.

As shown in FIG. 5, lid 20 includes a funnel-shaped shroud 50. Shroud 50 is shaped and located so that as drum 18 rotates about axis 23 (hinge joint 22), the gap between the curved section of drum 18 and shroud 50 remains essentially uniform. A snout or lip 52 encircles a hole 54 at the base of shroud 50, projecting away from drum 18 into the interior of container 14. A foam sheet 56 lining the surface of shroud 50, and/or a ring seal 58 surrounding hole 54, substantially seals the gap between drum 18 and shroud 50 to reduce the escape of vapors from container 14.

Lid 20 removably attaches to container 14 via a lip 60 extending around the circumference of lid 20. Lip 60 engages a flange 62 on a sleeve 64 at the top of container 14. Lid 20, which is made of, e.g., plastic, also includes two handles 66. Forcing handles 66 upward and outward flexes lid 20 sufficiently to disengage lip 60 from flange 62, allowing cover assembly 16 to be detached from container 14. A channel 67 at the base of sleeve 64 snaps over the top edge of container 14, allowing sleeve 64 to rotate with respect to container 14. Because lid 20 attaches to container 14 through flange 62 on sleeve 64, cover assembly 16 can thus be rotated with respect to container 14.

The operation of pail 10 is described with reference also to FIGS. *6a–6f*. With cover assembly 16 removed, a plastic bag 68 is placed into container 14, and the edges of bag 68 are draped over the outside surface of sleeve 64. Cover assembly 16 is then installed by pressing down on lid 20 and flexing it to cause lip 60 to engage flange 62, trapping bag 68 between cover assembly 16 and sleeve 64.

With bag 68 in place, a soiled diaper 12 is inserted into cylinder 32 in drum 18. Piston 38 prevents diaper 12 from dropping into container 14, and also (together with O-rings 40) prevents odors within container 14 from escaping through cylinder 32. Handle 26 is then manipulated to rotate drum 18 180°, until handle 26 is at the other side of cover assembly 16. When cylinder 32 aligns with hole 54, the combined weight of piston 38 and weight 42 forces diaper 12 though hole 54 and into bag 68. At this point, piston 38 is at the bottom of cylinder 32, and another diaper 12 may be disposed of by repeating the above-described process and using handle 26 to rotate drum 18 back to its original orientation. Throughout the disposal process (as well as before and after), seal 46 and ring seal 48 prevent odors within container 14 from escaping between drum 18 and shroud 50. Cover assembly 16 is thus a one-way valve that allows diaper 12 to be placed into container 14 without odor backflow or leakage.

As depicted in FIGS. *6d–6f*, when bag 68 is substantially filled with diapers 12 and it is desired to replace bag 68 with a fresh garbage bag, cover assembly 16 is rotated with respect to container 14. Because of the weight of diapers 12 in bag 68, rotating cover 16 causes the top portion of bag 68 (which is trapped between lid 20 and sleeve 64) to rotate with respect to the bottom portion, twisting bag 68 shut. After one or two revolutions, cover assembly 16 is detached and bag 68 is removed from container 14. Because bag 68 was twisted shut prior to the removal of cover assembly 16, very little odor escapes during the bag removal process.

Figure 7:
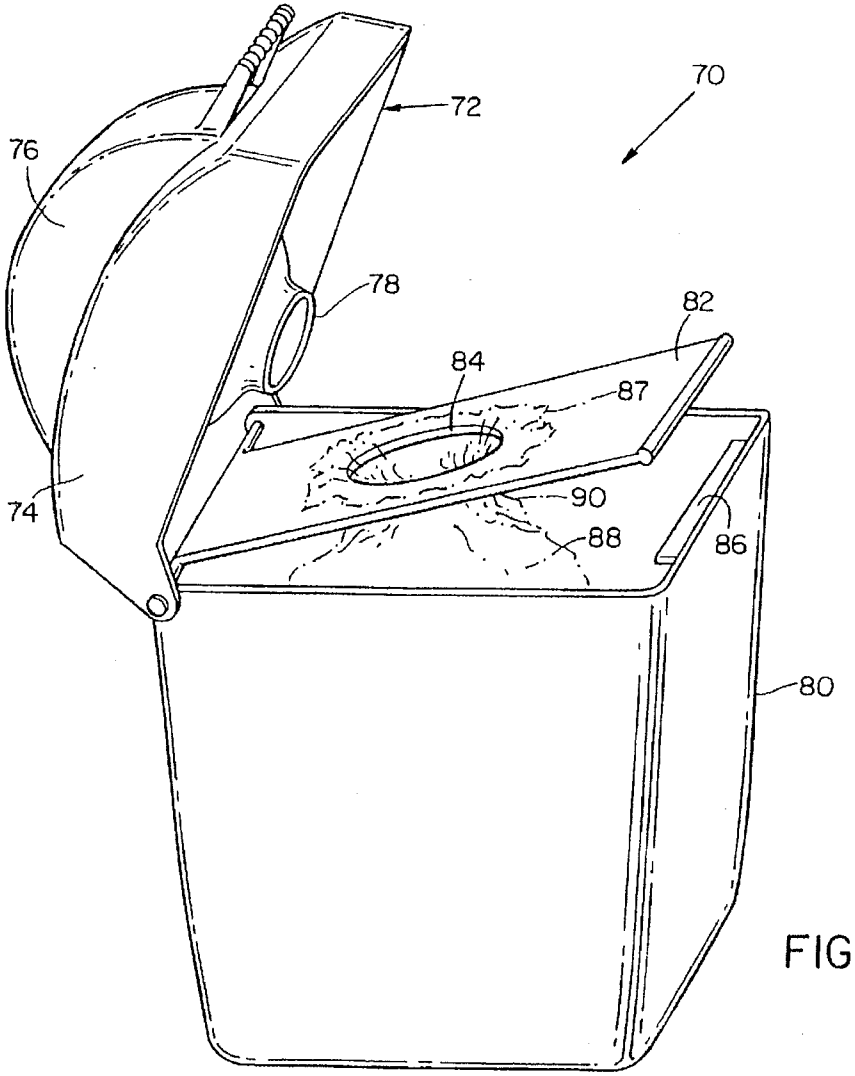
FIG. 7 is a perspective view of another diaper pail embodiment.
Figure 6C:
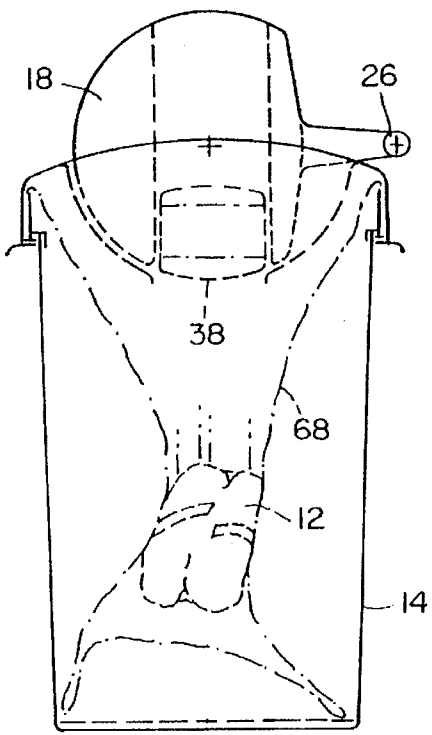
FIGS. 6*a*–6*f* are cutaway side views showing modes of operation of the diaper pail shown in FIG. 1.
Figure 6B:
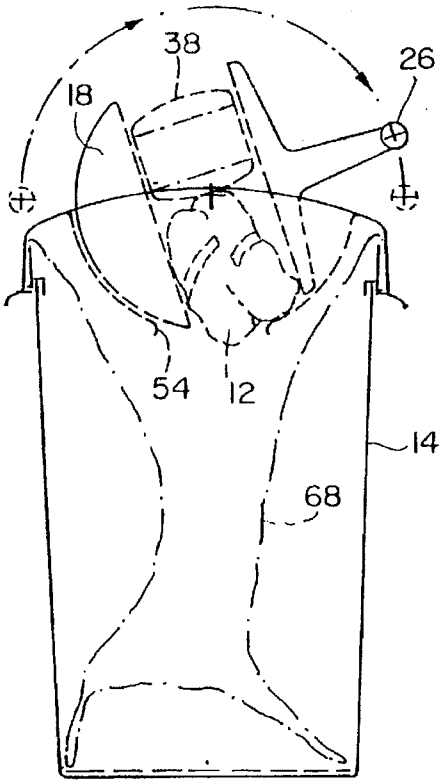
Figure 6A:
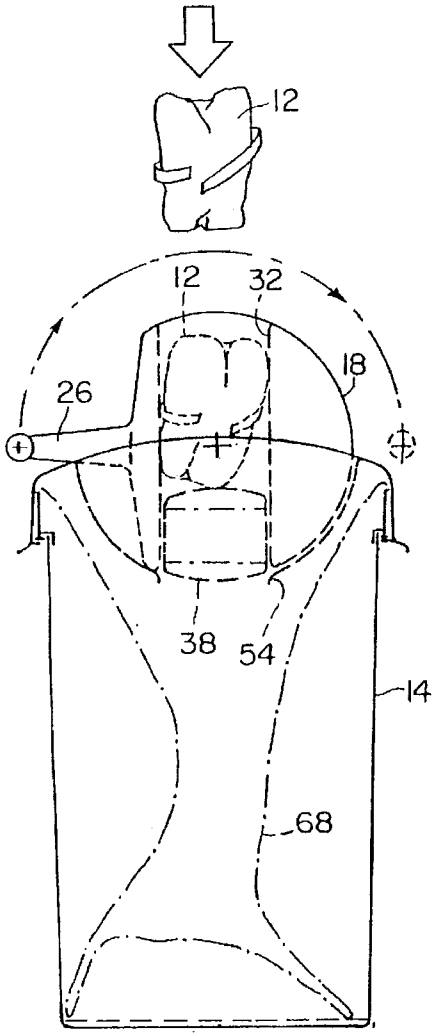
Figure 6F:
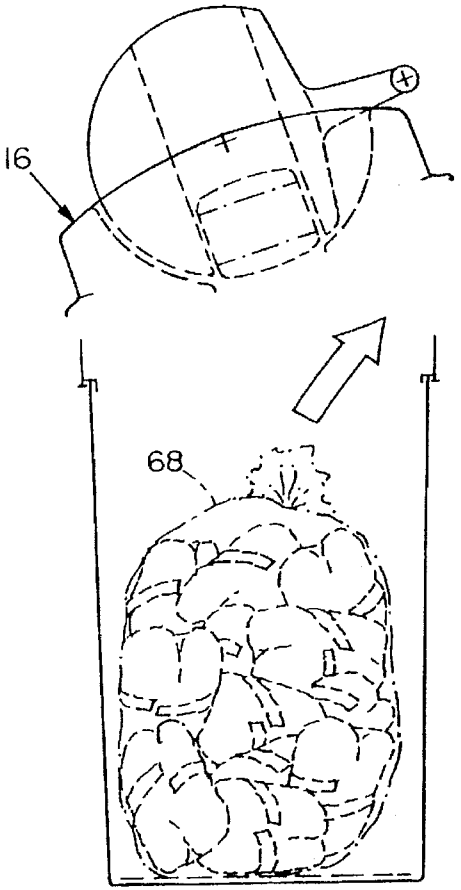
Figure 6E:
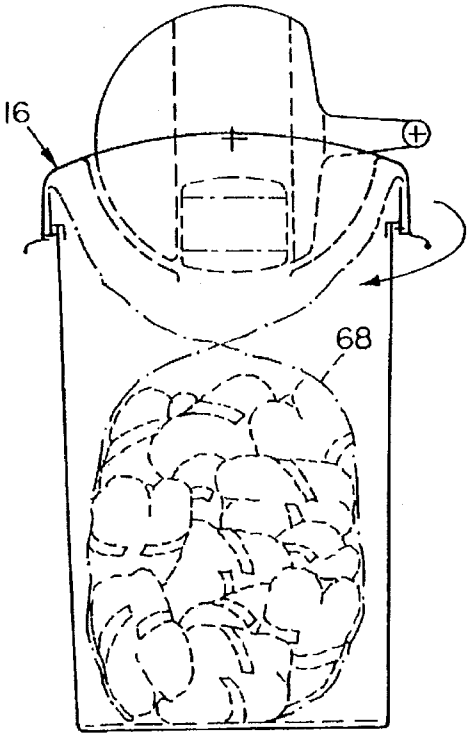
Figure 6D:
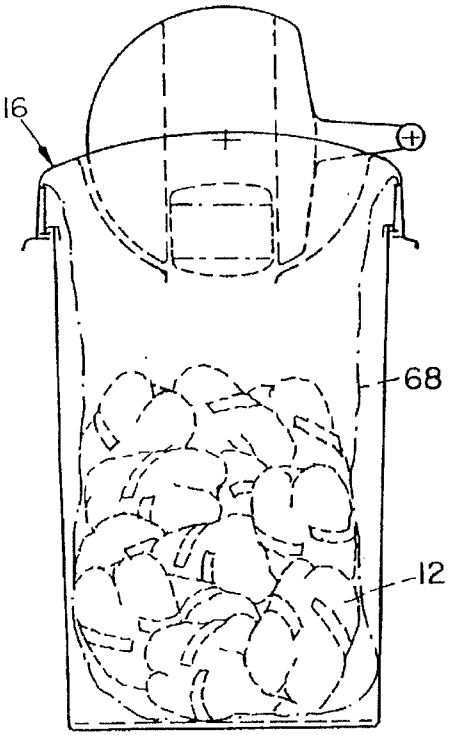

With reference now to FIG. 7, there is shown a perspective view of another embodiment of the invention, a pail 70 for disposing of and storing, e.g., soiled diapers. A cover assembly 72 includes a lid 74, a rotating drum 76, and a snout 78, all substantially as described above, but without a flat spot on the drum. Cover assembly 72 is hinged with respect to a container 80, but need not be hinged. Pail 70 further includes a bag retainer member 82. Bag retainer 82, which is hinged with respect to container 80 and cover 72, includes a hole 84. The diameter and location of hole 84 are selected such that snout 78 wedges into hole 84 when bag retainer 82 is rotated toward drum 76. A stop 86 prevents bag retainer 82 from swinging down into container 80.

Generally, the sizes and shapes of snout 78 and hole 84 are selected in accordance with the cross sectional area and shape of the object or objects to be deposited into container 80. In particular, snout 78 and hole 84 are sized and shaped so that, properly oriented, the object just passes through snout 78 (with some clearance to account for anticipated variation in size among objects of the same general type). The requisite cross section of snout 78 is therefore determined by the characteristic cross section of the object (e.g., the largest cross section of the object along axis 33 when the object is placed into cylinder 32). Thus, because a rolled diaper is roughly a cylinder with a generally uniform circular cross section approximately 4 to 6 in. (10.16 to 15.24 cm.) in diameter, snout 78 and hole 84 are made round, with diameters of about 6 to 7 in. (15.24 to 17.78 cm.), just large enough to allow a single diaper 12 to pass through. An acceptable range of diameters is 2 to 11 inches.

In operation, the mouth 87 of a bag 88 (shown in phantom for clarity) is gathered, threaded through hole 84, and splayed over the top surface of bag retainer 82. Because snout 78 and hole 84 are generally substantially smaller in diameter than the mouth of a typical garbage bag (which may be, e.g., 18 to 24 in.—45.72 to 60.96 cm.—in diameter, three to four times the diameters of snout 78 and hole 84), bag 88 necks down as it passes through hole 84. After bag 88 has been installed, cover assembly 72 is then rotated downward, until it engages the top lip of container 80, and snout 78 wedges into hole 84, trapping bag 88 in place. At this point, stop 86 prevents bag retainer 82 from swinging down into container 80. Cover assembly 72 is then operated as described above to dispose of soiled diapers (not shown).

Bag retainer 82 may be replaced by a smaller and/or nonhinged functionally similar part, including an elastic band to secure the bag to the snout.

When bag 88 is filled, cover assembly 72 and bag retainer 82 are rotated upward together. The necked-down portion 90 of bag 88 is then squeezed by hand, twisted shut and/or tied off, before bag retainer 82 is separated from cover assembly 72. Alternatively, because the necked-down portion 90 of bag 88 directly below bag retainer 82 is generally small in diameter, it may be grabbed with one hand and crushed closed to seal the bag opening. Bag retainer 82 is then separated from cover assembly 72 with the other hand to allow the filled bag 88 to be removed from container 80, all the while keeping necked-down portion 90 crushed closed to seal bag 88. Bag 88 can then be tied off and/or disposed of in a normal manner. Because bag 88 is never opened to atmosphere, essentially no odor escapes during the bag removal process.

Other embodiments are within the claims.

For example, although in the embodiments described herein the piston moves under the force of gravity, the piston may additionally or alternatively be manually actuated or be driven by a mechanism, such as a spring-driven actuator or any type of device that produces the requisite reciprocal or oscillating motion. Similarly, the drum need not be rotated manually. In addition, although described in connection with diaper disposal, the invention may be suitable for the disposal of other materials that emit harmful or unpleasant vapors, or for the disposal of sharps or other articles that cannot safely be stored in open, easily accessible containers. In general, the invention described herein may be useful in many applications in which it is desirable to pump or move a volume of material from one region to another.

Further, although in the embodiments described herein the drum is a semi-cylindrical section, it may be other shapes instead, such as spherical or partially spherical, and it need not have a circular or partially circular cross section along its axis of rotation. In addition, the cylinder in the rotating drum need only be open at one end. In such an embodiment, it may be desirable to vent the closed end of the cylinder to facilitate the motion of the piston.

Moreover, although bag retainer 82 is shown and described as a separate member pivotally attached to the container 80, other structures for attaching the mouth of bag 88 to snout 78, such as a rubber band or a ring, could alternatively be employed.

What is claimed is:

1. Apparatus for placing an article into a container, said apparatus comprising:

drum means including a hollow elongated tubular member having an open end and a longitudinal axis and sized to receive the article;

piston means disposed within said hollow elongated tubular member and sized to slide within said hollow elongated tubular member along said longitudinal axis;

a lid for attachment to the container;

structure including a shroud having a disposal hole for communicating with the interior of the container, said structure coupling said drum means to said lid for rotational movement between a first position whereat said open end is distant from the disposal hole and oriented to receive the article to be disposed and a second position whereat said open end is aligned with the disposal hole for delivering the article to be disposed to the container; and sealing means for maintaining closure between said shroud and at least one of said drum means and said piston means.

2. Apparatus in accordance with claim 1 wherein said elongated tubular member is a cylinder.

3. Apparatus for supporting a bag having a mouth larger than a characteristic cross section of an article to be deposited therein, said apparatus comprising:

a container sized to receive the bag;

a bag retaining member having a hole adapted to allow the mouth of the bag to be passed therethrough, hole being larger than a characteristic cross section of the article;

a lid for attachment to the container;

drum means on said lid including a hollow elongated tubular member having a longitudinal axis and sized to receive the article;

piston means disposed within said hollow elongated tubular member and sized to slide within said hollow elongated tubular member along said longitudinal axis;

structure including a shroud having a disposal hole for communicating with the interior of the container, said structure coupling said drum means to said lid for rotational movement between a first position whereat said open end is distant from the disposal hole and oriented to receive the article to be disposed and a second position whereat said open end is aligned with the disposal hole for delivering the article to be disposed to the container; and sealing means for maintaining closure between said shroud and at least one of said drum means and said piston means;

said shroud including a snout surrounding the disposal hole and projecting away from said drum means into the hole of said bag retaining member to wedge the mouth of the bag between the sealing member and the bag retaining member, thereby releasably securing the bag to the hole of said bag retaining member so that the bag is gathered in the region of its mouth to provide an opening into the bag generally sized to enable the article to pass freely therethrough.

4. Apparatus in accordance with claim 3 wherein said container has an upper peripheral flange; and wherein said bag retaining member is pivotally attached to said container adjacent said upper peripheral flange of said container.

5. Apparatus for disposing an article into a container having an opening, said apparatus comprising:

a closure assembly mounted on the container to close the opening thereof, said assembly including a support means and a shroud having a disposal hole for communicating with the interior of the container;

drum means including a hollow elongated tubular member having at least one open end, said drum means being rotatably mounted on said support means for movement between a first position whereat said open end is distant from the disposal hole and a second position whereat said open end is aligned with the disposal hole; and piston means slidably received in the tubular member movable between a first position distant from said open end and a second position at said open end to maintain said tubular member closed;

whereby, when an article to be disposed is placed through said open end into the tubular member when said drum means is in the first position, and when said drum means is moved to the second position, the article moves by gravity and under the influence of said piston means back through the tubular member to and through the open end and the disposal hole into the container.

6. Apparatus in accordance with claim 5 including:

seal means for maintaining closure between said shroud and at least one of said drum means and said piston means.

7. Apparatus in accordance with claim 6 wherein said seal means includes a sheet seal disposed between said drum means and said shroud.

8. Apparatus in accordance with claim 6 wherein said seal means includes at least one seal disposed between said piston and said elongated tubular member.

9. Apparatus in accordance with claim 5 wherein said elongated tubular member is a cylinder.

10. Apparatus in accordance with claim 5 wherein said elongated tubular member has a longitudinal axis and said drum means has an axis of rotation, said axes being mutually perpendicular.

11. Apparatus in accordance with claim 10 wherein said drum means, with said elongated tubular member therein, is pivotally supported by said support means for rotation about said second axis with respect to said support means.

12. Apparatus in accordance with claim 5 and further comprising:

a retainer ring disposed in said at least one open end of said elongated tubular member to retain said piston within said elongated tubular member.

13. Apparatus in accordance with claim 5 wherein said shroud has a concave surface leading toward and away from the disposal hole; and wherein said drum means has an outer peripheral surface at least partially disposed adjacent said concave surface to maintain a continuous closure of the container during rotational movement of said drum means.

14. Apparatus in accordance with claim 13 wherein said drum means and said shroud comprise a closure assembly adapted to engage the container so that said cover assembly is removable with respect to the container.

15. Apparatus in accordance with claim 13 and further comprising a seal disposed between said drum means and said shroud.

16. Apparatus in accordance with claim 15 wherein said seal between said drum means and said shroud comprises a foam sheet contiguous with said concave surface.

17. Apparatus in accordance with claim 15 wherein the disposal hole in said shroud is of substantially the same dimension as said hollow elongated tubular member and located such that said hollow elongated tubular member aligns with the disposal hole when said drum means is rotated to the second position.

18. Apparatus in accordance with claim 17 wherein said seal between said drum means and said shroud comprises a ring seal encircling the disposal hole.

19. Apparatus in accordance with claim 17 wherein said shroud includes a snout surrounding the disposal hole and projecting away from said outer peripheral surface of said drum means.

20. Apparatus in accordance with claim 19 and further comprising a bag retaining member for holding a mouth region of a bag adjacent to said snout.

* * * * *